US007878722B2

(12) United States Patent
Matsuda

(10) Patent No.: US 7,878,722 B2
(45) Date of Patent: Feb. 1, 2011

(54) METHOD OF DEVELOPING PHOTOSENSITIVE MATERIAL AND METHOD OF PRODUCING CONDUCTIVE LAYER-ATTACHED FILM

(75) Inventor: Toyomi Matsuda, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 210 days.

(21) Appl. No.: 12/123,588

(22) Filed: May 20, 2008

(65) Prior Publication Data

US 2008/0292997 A1 Nov. 27, 2008

(30) Foreign Application Priority Data

May 21, 2007 (JP) ..... 2007-134082

(51) Int. Cl.
*G03D 3/08* (2006.01)

(52) U.S. Cl. ..... 396/612; 396/827

(58) Field of Classification Search ..... 396/612, 396/627, 628, 646; 226/97.3, 97.4; 406/88
See application file for complete search history.

(56) References Cited

U.S. PATENT DOCUMENTS 3,186,326 A * 6/1965 Schmidt ..... 396/620
3,521,802 A * 7/1970 Bossons ..... 242/615.12
3,873,317 A * 3/1975 Kato et al. ..... 430/232
4,138,047 A * 2/1979 Sherman ..... 226/7
4,342,413 A * 8/1982 Reba ..... 242/615.12
6,131,847 A * 10/2000 Theilacker et al. ..... 242/615.12
2002/0195009 A1* 12/2002 Boucher ..... 101/228

FOREIGN PATENT DOCUMENTS

JP 8-245028 9/1996
JP 2006-332459 12/2006
JP 2007041057 A * 2/2007

OTHER PUBLICATIONS

English Machine translation of JP 2006-332459A.*

* cited by examiner

*Primary Examiner*—Clayton E Laballe
*Assistant Examiner*—Leon W Rhodes
(74) *Attorney, Agent, or Firm*—Young & Thompson

(57) ABSTRACT

An in-liquid turn bar disposed in a developing tank is set to discharge developer from plural slit-shaped discharge openings of a first cylindrical member such that a discharge rate of the developer per 1 m of the photosensitive material turning member is from 50 to 200 l/min (litter/minute). Regulating plates protruding from a surface of the first cylindrical member are provided at both transverse ends of the first cylindrical member. The amount of the developer discharged from both transverse ends of a photosensitive web is controlled by the regulating plates, thereby adjusting a gap between the first cylindrical member and the photosensitive web. Accordingly, the gap between the photosensitive web and the in-liquid turn bar is substantially uniform in a transverse direction, and thus the photosensitive web is turned without contact with the in-liquid turn bar.

17 Claims, 9 Drawing Sheets

METHOD OF DEVELOPING PHOTOSENSITIVE MATERIAL AND METHOD OF PRODUCING CONDUCTIVE LAYER-ATTACHED FILM

CROSS-REFERENCE TO RELATED APPLICATION

This application claims priority under 35 USC 119 from Japanese Patent Application No. 2007-134082, the disclosure of which is incorporated by reference herein.

BACKGROUND

1. Field of the Invention

The present invention relates to a method of developing a photosensitive material in which an exposed band-shaped photosensitive material is developed in developer and a method of producing a conductive layer-attached film.

2. Related Art

In recent, there is known an electromagnetic wave shield film of a PDP (plasma display panel) as a light transmittable conductive film which is formed by exposing and developing a silver salt material and is processed by a surface resistance reducing treatment.

In producing the electromagnetic wave shield film of the PDP using the silver salt photosensitive material, to improve conductivity of develop silver of the silver salt, it is effective to decrease an amount of a binder of a silver salt emulsion or increase an amount of swelling of the silver salt emulsion coating film, as disclosed in Japanese Patent Application Laid-Open (JP-A) No. 2006-332459. However, strength of a silver salt coating film decreases at the time of development and an amount of silver elution increases at the time of development. Accordingly, in general roller-transport automatic developing device, the silver salt coating film is peeled off or reduction silver is attached to a film surface through a roller to easily cause a surface-shaped defect.

As a countermeasure thereof, as disclosed in Japanese Patent Application Laid-Open (JP-A) No. 8-245028, there is proposed an apparatus in which processing solution is ejected from plural nozzle holes formed on a surface of a turning member serving as a conveyance guide and a gap is formed between the turning member and the film, thereby conveying the film without contact.

However, in the apparatus described in JP-A No. 8-245028, the processing solution is ejected from plural nozzle holes formed on a surface of the turning member, and thus an area where the processing solution is ejected and an area where the processing solution is not ejected may occur throughout the transverse direction of the turning member.

For example, in case of performing a development process, when developer is not uniformly applied throughout the transverse direction of the turning member, a difference in rate of development occurs because renewal of the developer on the surface of the silver salt containing layer is not uniform. As a result, striped non-uniformity may occur on the developed silver image.

To uniformly eject the developer in the transverse direction of the turning member, plural slits may be provided throughout the transverse direction of the turning member. However, in case of merely providing slit-shaped openings, it is difficult to make the ejection amount of the developer uniform throughout the transverse direction of the turning member, and a difference in floating amount of the film may occur in the transverse direction of the turning member. As a result, the aforementioned difference in rate of development occurs, and thus non-uniformity may occur on the developed silver image.

SUMMARY OF THE INVENTION

The invention is made to solve the aforementioned problems, and the invention is to provide a method of developing a photosensitive material and a method of producing a conductive layer-attached film, which are capable of obtaining a substantially uniformly developed silver image having no stain in a transverse direction, without occurrence of silver stain, scratch, film peeling, or the like.

In order to solve the aforementioned problems, according to a first aspect of the invention, there is provided a method of developing a photosensitive material, the method including: conveying a band-shaped photosensitive material having a silver salt containing layer on a base film into developer to develop the photosensitive material; and turning the band-shaped photosensitive material by a photosensitive material turning member disposed in a direction crossing a conveying direction of the band-shaped photosensitive material in the developer, wherein the developer is discharged from a plurality of slit-shaped discharge openings formed on a surface of the photosensitive material turning member along a longitudinal direction thereof, so that a discharge amount of the developer is from 50 l/min to 200 l/min per 1 m of the photosensitive material turning member, such that the band-shaped photosensitive material floats with respect to the photosensitive material turning member and is turned without contacting the photosensitive material turning member.

According to the first aspect of the invention, the band-shaped photosensitive material having the silver salt containing layer on the base film is conveyed into the developer and is developed. In the developer, the photosensitive material turning member is disposed in the direction crossing the conveying direction of the band-shaped photosensitive material, and the developer is discharged from the plural slit-shaped discharge openings formed on the surface thereof along the longitudinal direction so that the discharge amount (rate) of the developer per 1 in is from 50 to 200 l/min (litter/minute). The band-shaped photosensitive material is allowed to substantially uniformly float from the surface of the photosensitive material turning member in the transverse direction by the developer discharged from the plural slit-shaped discharge openings, and the band-shaped photosensitive material is turned without contact with the surface of the photosensitive material turning member. For this reason, silver stain, scratch, or the like of the band-shaped photosensitive material caused by contact between the surface of the photosensitive material turning member and the band-shaped photosensitive material is suppressed, and film peeling (the silver salt coating film or the developed silver image is peeled off) or the like caused by high discharge flow of the developer is suppressed. Therefore, it is possible to obtain a substantially uniform developed silver image without non-uniformity in the transverse direction on the base film.

When the discharge rate of the developer per 1 m in the photosensitive material turning member is lower than 50 l/min, the band-shaped photosensitive material does not sufficiently float from the surface of the photosensitive material turning member at some portion of the transverse direction, and silver stain, scratch, or the like may occur in the band-shaped photosensitive material by contact between the surface of the photosensitive material turning member and the band-shaped photosensitive material. When the discharge rate of the developer per 1 m in the photosensitive material turning member is higher than 200 l/min, the discharge flow of the developer becomes higher and thus film peeling may occur.

According to a second aspect of the invention, there is provided a method of developing a photosensitive material, the method including: conveying a band-shaped photosensitive material having a silver salt containing layer on a base film into developer to develop the photosensitive material; and turning the band-shaped photosensitive material by a photosensitive material turning member disposed in a direction crossing a conveying direction of the band-shaped photosensitive material in the developer, wherein the developer is discharged from a plurality of slit-shaped discharge openings formed on a surface of the photosensitive material turning member along a longitudinal direction thereof, and the band-shaped photosensitive material floats with respect to the photosensitive material turning member and is turned without contacting the photosensitive material turning member, and the amount of the developer that flows away from both transverse ends of the band-shaped photosensitive material is regulated by regulating plates disposed at both transverse ends of the photosensitive material turning member, thereby adjusting a gap between the band-shaped photosensitive material and the photosensitive material turning member.

According to the second aspect of the invention, the band-shaped photosensitive material having the silver salt containing layer on the base film is conveyed into the developer and is developed. In the developer, the photosensitive material turning member is disposed in the direction crossing the conveying direction of the band-shaped photosensitive material, and the developer is discharged from the plural slit-shaped discharge openings formed on the surface thereof along the longitudinal. The band-shaped photosensitive material is allowed to float from the surface of the photosensitive material turning member to be turned without contact by the developer discharged from the discharge openings. At that time, the amount of the developer discharged (flowed) from both transverse ends of the band-shaped photosensitive material is regulated by the regulating plates provided at both transverse ends of the photosensitive material turning member, thereby adjusting the gap between the band-shaped photosensitive material and the photosensitive material turning member. Accordingly, the gap between the band-shaped photosensitive material and the photosensitive material turning member is substantially uniform in the transverse direction. For this reason, silver stain, scratch, or the like of the band-shaped photosensitive material caused by contact between the surface of the photosensitive material turning member and the band-shaped photosensitive material is suppressed, and film peeling or the like caused by high discharge flow of the developer is suppressed. Therefore, it is possible to obtain a substantially uniform developed silver image without non-uniformity in the transverse direction on the base film.

According to a third aspect of the invention, in the method of developing a photosensitive material of the first or second aspect of the invention, an opening ratio of the discharge openings is from 0.6 to 2% to control an amount of the developer discharged from the discharge openings.

According to the third aspect of the invention, the opening ratio of the discharge openings is set from 0.6 to 2%, thereby appropriately adjusting the amount of the developer discharged from the plural slit-shaped discharge openings. Accordingly, the gap between the band-shaped photosensitive material and the photosensitive material turning member is further more uniform. For this reason, silver stain, scratch, or the like of the band-shaped photosensitive material caused by contact between the surface of the photosensitive material turning member and the band-shaped photosensitive material is suppressed, and film peeling or the like caused by high discharge flow of the developer is suppressed. When the opening ratio of the discharge openings is smaller than 0.6%, the amount of the developer discharged from the plural discharge openings is not sufficiently and thus silver stain, scratch, or the like of the band-shaped photosensitive material may occur by contact between the surface of the photosensitive material turning member and the band-shaped photosensitive material. When the opening ratio of the discharge openings is larger than 2%, the discharge flow of the developer becomes high and thus film peeling or the like may occur.

According to a fourth aspect of the invention, there is provided a method of producing a conductive layer-attached film, the method including: forming a metal silver portion (on a base film) by developing a band-shaped photosensitive material by using the method of developing a photosensitive material of any one of the first to the third aspects; and plating for forming a conductive layer on the metal silver portion (forming a conductive layer).

According to the fourth aspect of the invention, the conductive layer-attached film is produced by performing forming a metal silver portion by developing a band-shaped photosensitive material by using the method of developing a photosensitive material of any one of the first to the third aspects; and plating for forming a conductive layer on the metal silver portion. At this time, silver stain, scratch, or the like of the band-shaped photosensitive material caused by contact between the surface of the photosensitive material turning member and the band-shaped photosensitive material is suppressed, and film peeling or the like caused by high discharge flow of the developer is suppressed. Therefore, it is possible that a substantially uniform metal silver portion without non-uniformity in the transverse direction is formed on the band-shaped photosensitive material, and by plating on the metal silver portion, a substantially uniform conductive layer-attached film without non-uniformity is obtained.

According to a fifth aspect of the invention, there is provided a method of developing a photosensitive material of any one of the first to third aspects of the invention, the photosensitive material turning member includes: a first cylindrical member disposed in a direction crossing a conveying direction of the band-shaped photosensitive material that has, on a surface thereof in a longitudinal direction, a plurality of slit-shaped discharge openings that discharge the processing solution; and a second cylindrical member disposed inside the first cylindrical member that has nozzles that eject the processing solution.

According to the fifth aspect of the invention, the photosensitive material turning member provided in the tank has the first cylindrical member disposed in the direction crossing the conveying direction of the band-shaped photosensitive material and the second cylindrical member disposed inside the first cylindrical member. In the first cylindrical member, the plural slit-shaped discharge openings are formed along the longitudinal direction on the surface thereof. In the second cylindrical member, the nozzles are formed. The processing solution is ejected from the nozzles of the second cylindrical member into the first cylindrical member, and the processing solution in the first cylindrical member is discharged from the plural slit-shaped discharge openings to the gap between the first cylindrical member and the band-shaped photosensitive material. Accordingly, the band-shaped photosensitive material is allowed to float from the surface of the first cylindrical member, and the band-shaped photosensitive material is turned without contact with the surface of the first cylindrical member. For this reason, contact between the band-shaped photosensitive material and the surface of the first cylindrical member is suppressed, and thus silver stain, scratch, film peeling (the silver salt coating film or the developed silver image is peeled off) or the like of the band-shaped photosensitive material is suppressed. In addition, since the processing solution is discharged continuously in the longitudinal direction from the slit-shaped discharge openings of the first cylindrical member, it is possible to suppress stain in processing of the band-shaped photosensitive material in the transverse direction.

According to a sixth aspect of the invention, in the method of developing a photosensitive material according to the fifth aspect, intervals between the discharge openings on a conveying direction upstream side and a conveying-direction downstream side are smaller than intervals between the discharge openings at a conveying-direction middle portion.

According to the sixth aspect of the invention, since the intervals between the discharge openings on the conveying-direction upstream side and the conveying-direction downstream side are smaller than the intervals between the discharge openings on the conveying-direction middle portion, the processing solution is discharged from the discharge openings, having the smaller intervals than those of the conveying-direction middle portion, on the conveying-direction upstream side and the conveying-direction downstream side of the band-shaped photosensitive material. The processing solution discharged from the discharge openings of the first cylindrical member is discharged (flowed) in the four directions of both transverse ends of the band-shaped photosensitive material, and the inlet on the conveying-direction upstream side and the outlet on the conveying-direction downstream side of the band-shaped photosensitive material. However, in the inlet on the conveying-direction upstream side and the outlet on the conveying-direction downstream side of the band-shaped photosensitive material, the band-shaped photosensitive material and the photosensitive material turning member may easily come into contact with each other. In the invention, in the inlet on the conveying-direction upstream side and the outlet on the conveying-direction downstream side of the band-shaped photosensitive material, the processing solution is discharged from the discharge openings having the intervals smaller than those of the conveying-direction middle portion. Accordingly, the processing solution is sufficiently discharged on the conveying-direction upstream side and the conveying-direction downstream side of the photosensitive material, and thus contact between the band-shaped photosensitive material and the first cylindrical member is suppressed. Therefore, silver stain, scratch, film peeling, or the like of the bald-shaped photosensitive material is further suppressed.

According to a seventh aspect of the invention, in the method of developing a photosensitive material according to the fifth aspect or the sixth aspect, the photosensitive material turning member further includes regulating plates disposed at both longitudinal ends of the first cylindrical member that protrude from a surface of the first cylindrical member, and that regulate the amount of the processing solution that flows away from both transverse ends of the band-shaped photosensitive material.

According to the seventh aspect of the invention, the regulating plates protruding from the surface of the first cylindrical member are provided at both longitudinal ends of the first cylindrical member, the amount of the developer discharged (flowed) from the gap between the band-shaped photosensitive material and the first cylindrical member at both transverse ends of the band-shaped photosensitive material is controlled. Accordingly, it is possible to adjust the gap between the band-shaped photosensitive material and the first cylindrical member. For this reason, the contact between the surface of the first cylindrical member and the band-shaped photosensitive material is further suppressed, and thus silver stain, scratch, film peeling, or the like of the band-shaped photosensitive material is suppressed. In addition, stain in processing of the band-shaped photosensitive material in the transverse direction is suppressed.

According to an eighth aspect of the invention, in the method of developing a photosensitive material according to the seventh aspect, heights of the regulating plates from the surface of the first cylindrical member are larger than a gap between the surface of the first cylindrical member and the floated band-shaped photosensitive material.

According to the eighth aspect of the invention, since the heights of the regulating plates from the surface of the first cylindrical member are larger than the gap between the first cylindrical member and the band-shaped photosensitive material, the amount of the developer discharged (flowed) from both transverse ends of the band-shaped photosensitive material is further controlled. Therefore, it is possible to further efficiently adjust the gap between the band-shaped photosensitive material and the first cylindrical member.

According to a ninth aspect of the invention, in the method of developing a photosensitive material according to any one of the fifth aspect to the eighth aspect, the discharge openings are formed in a tapered shape, which are wider on a front surface side of the first cylindrical member and narrower on a rear surface side of the first cylindrical member.

According to the ninth aspect of the invention, the discharge openings are formed in the tapered shape, which becomes wider on the front surface side of the first cylindrical member and becomes narrower on the rear surface side. Therefore, fluid pressure of the processing solution discharged from the discharge openings is suppressed from rising, and thus film peeling or the like of the band-shaped photosensitive material is suppressed.

According to a tenth aspect of the invention, in the method of developing a photosensitive material according to the fifth aspect, the second cylindrical member is provided with an introduction portion that introduces the processing solution at one longitudinal end of the second cylindrical member, and the nozzles are a plurality of nozzle holes formed in the longitudinal direction, and the nozzle holes formed at the other longitudinal end are smaller than the nozzle holes formed at the one longitudinal end.

According to the tenth aspect of the invention, the processing solution is introduced to the introduction portion provided at one longitudinal end of the second cylindrical member, and the processing solution is ejected from the plural nozzle holes formed in the longitudinal direction of the second cylindrical member. In this case, since the nozzle holes provided at the other longitudinal end side of the second cylindrical member are smaller than the nozzle holes provided at the one longitudinal end side thereof, a difference in amount of the processing solution ejected from the nozzle holes on the other end side and the one end side becomes small. Accordingly, the processing solution discharged from the plural slit-shaped discharge openings of the first cylindrical member is substantially uniform in the transverse direction. For example, when the processing solution is introduced from one longitudinal end of the second cylindrical member, and the plural nozzle holes of the second cylindrical member has the same diameter from one longitudinal end to the other end, or the second cylindrical member is disposed only at the introduction port in the first cylindrical member, static pressure on the other end side of the first cylindrical member is high, the amount of the processing solution discharged from the discharge opening at the other end side tends to be high and the amount of the processing solution discharged from the discharge opening at the one end side (introduction side) tends to be low. In the invention, since the nozzle holes formed at the other longitudinal end side are smaller than the nozzle holes formed at the one longitudinal end side (introduction side), the difference in amount of the processing solution ejected from the nozzle holes at the other end side and the nozzle holes at the one end side is small. As a result, the developer discharged from the plural discharge holes of the first cylindrical member is substantially uniform in the transverse direction.

According to an eleventh aspect of the invention, in the method of developing a photosensitive material according to the tenth aspect, the nozzle holes become gradually larger from the other longitudinal end to the one longitudinal end of the second cylindrical member.

According to the eleventh aspect of the invention, since the nozzle holes are formed gradually larger as they go from the other longitudinal end to the one longitudinal end of the second cylindrical member, the difference in amount of the processing solution ejected from the plural nozzle holes becomes smaller. For this reason, the developer discharged from the plural discharge openings of the first cylindrical member is further uniform in the transverse direction.

According to a twelfth aspect of the invention, in the method of developing a photosensitive material according to the fifth aspect or the sixth aspect, the first cylindrical member has no discharge opening at a portion that faces the nozzles of the second cylindrical member.

According to the twelfth aspect of the invention, since the first cylindrical member has no discharge opening at a portion thereof facing the nozzles, the developer ejected from the nozzles of the second cylindrical member abut the inner wall of the first cylindrical member to suppress dynamic pressure, and the developer flowing to both sides of the inner wall is discharged from the discharge openings of the first cylindrical member, thereby suppressing short pass that the developer ejected from the nozzles of the second cylindrical member is directly ejected from the discharge openings of the first cylindrical member.

As described above, according to the invention, it is possible to suppress silver stain, scratch, or the like of the band-shaped photosensitive material, and it is possible to suppress film peeling or the like. Therefore, it is possible to obtain a substantially uniform developed silver image (a metal silver portion) without non-uniformity in the transverse direction on the base film.

BRIEF DESCRIPTION OF THE DRAWINGS

Exemplary embodiments of the invention will be described in detail with reference to the following figures, wherein.

DETAILED DESCRIPTION OF THE INVENTION

Figure 1:
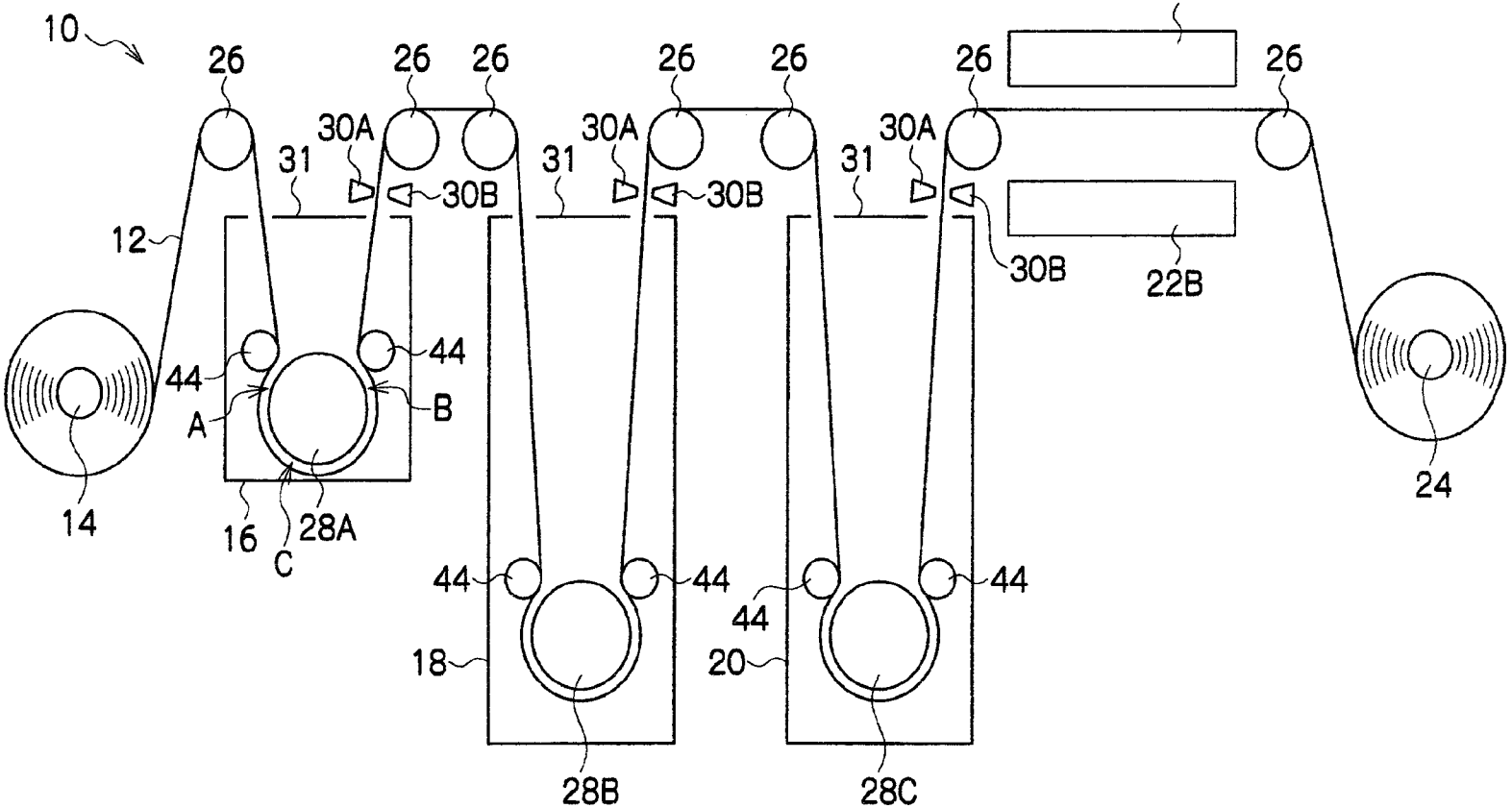
FIG. 1 is a schematic view illustrating a configuration of a developing apparatus to which a method of developing a photosensitive material is applied according to an embodiment of the invention.

Embodiments of the invention will be described with reference to the drawings. The same reference numerals are given to members having substantially the same functions throughout the whole figures, and the overlapping description thereof may be omitted.

FIG. 1 shows a developing apparatus to which a method of developing a photosensitive material according to the invention is applied. The developing apparatus is a device for developing, fixing, and washing a photosensitive web as a band-shaped photosensitive material which is exposed. As shown in FIG. 1, in the developing apparatus 10, a photosensitive web 12 having a silver salt containing layer on a band-shaped base film is wound on an unwinding shaft 14 in a roller shape, in which the silver salt containing layer faces upward. The photosensitive web 12 has been subjected to a desired fine line-shaped pattern exposure by an exposing device which is not shown in the drawings.

A developing tank 16 which stores developer, a fixing tank 18 which stores fixer, and a washing tank 20 which stores pure water (washing water) are disposed on a conveying-direction downstream side of the photosensitive web 12 fed from the unwinding shaft 14. Warm air generating devices 22A and 22B for drying both surface of the photosensitive web 12 are disposed on the conveying-direction further downstream side of the photosensitive web 12 than the washing tank 20. A winding shaft 24 for winding the photosensitive web 12 is disposed on the conveying-direction further downstream side of the photosensitive web 12.

The photosensitive web 12 fed from the unwinding shaft 14 passes through a support roller 26 disposed above the developing tank 16 and is conveyed to the developing tank 16. An in-liquid turn bar 28 as a photosensitive material turning member (a photosensitive material conveying direction changing member) is disposed in the developing tank 16, and the photosensitive web 12 is supported and turned by the in-liquid turn bar 28 so that the silver salt containing layer in non-contact state. Air knives 30A and 30B are disposed at an outlet of the developing tank 16 at the conveying-direction downstream side of the photosensitive web 12 so as to face to both surfaces of the photosensitive web 12. The developer on the photosensitive web 12 conveyed into the developing tank 16 is scraped and separated from the photosensitive web 12 at the outlet of the developing tank 16 by air blown from the air knives 30A and 30B, and the photosensitive web 12 passes through two support rollers 26 disposed above the developing tank 16 and above the fixing tank 18, and subsequently the photosensitive web 12 is introduced into the fixing tank 18.

Similarly with the case of the developing tank 16, the photosensitive web 12 is turned by an in-liquid turn bar 28B in the fixing tank 18 in a non-contact state of the silver salt containing layer, the fixer thereon is scraped and separated at the outlet of the fixing tank 18 by the air knives 30A and 30B which face to both surfaces of the photosensitive web 12, and the photosensitive web 12 passes through two support rollers 26 and is subsequently introduced into the washing tank 20. The photosensitive web 12 is turned by an in-liquid turn bar 28C in the washing tank 20 in a non-contact state of the silver salt containing layer, pure water thereon is scraped and separated at the outlet of the washing tank 20 by the air knives 30A and 30B disposed on both surfaces of the photosensitive web 12, and the photosensitive web 12 passes through a support roller 26 disposed above the washing tank 20 and is conveyed to the warm air generating devices 22A and 22B. Both surfaces of the photosensitive web 12 are dried by warm air generated by the warm air generating devices 22A and 22B, and the photosensitive web 12 passes through a support roller 26 and is wound on the winding shaft 24. Although not shown in the drawings, in the series developing apparatus 10, the unwinding shaft 14 is provided with a torque control mechanism so as to convey the photosensitive web 12 with a constant tension.

In such a developing apparatus 10, the photosensitive web 12 is conveyed in the developing tank 16, the fixing tank 18, and the washing tank 20 by the plural support rollers 26 and the in-liquid turn bars 28A, 28B, and 28C, and thus the developing, fixing, and washing processes are performed, and further, the photosensitive web 12 is dried, thereby obtaining the photosensitive web 12 (the conductive material) having a fine-line mesh-shaped developed silver image (a metal silver portion) formed thereon. The photosensitive web 12 which is obtained by being processed by the developing apparatus 10 can be preferably used as a light transmittable electromagnetic wave shield film. For example, a conductive layer is formed by performing plating (for example, Cu-plating or the like) to the fine-line mesh-shaped developed silver image (the metal silver portion) formed by the photosensitive web 12 being processed by the developing apparatus 10, thus the light transmittable electromagnetic wave shield film (the conductive layer-attached film) can be produced.

In the developing, fixing, and washing processes, a developing technique used for a silver salt photographic film, a photographic film for plate-making, an emulsion mask for a photomask, or the like is applicable. The developer, fixer, and washer may be appropriately applicable based thereon. The developer is not limited particularly, but PQ developer, MQ developer, MAA developer, or the like may be used. For example, there may be sued developer such as CN-16, CR-56, CP45X, FD-3, or Papitol produced by Fuji Film, Co., Ltd., C-41, E-6, RA-4, D-19, D-72 produced by KODAK Co., Ltd, developer contained in the kits thereof, and lith developer such as D-85. In addition, the fixing process is performed for stability by removing the silver salt on the unexposed part.

It is not preferable to take out and take in each of processing solutions from each of processing tanks of the developing tank 16, the fixing tank 18, and the washing tank 20 of the developing apparatus 10, because increase in supplement amount, promotion of solution physical development in the next tank, deterioration in processing solution, or the like occurs. Dripping of processing solution in a crossover portion from one tank to the next tank results in non-uniformity in processing and drying makes, thereby decreasing yield of products. In the developing apparatus 10 of the embodiment, since the air knives 30A and 30B which face to both surfaces of the photosensitive web 12 are disposed at the outlets of the developing tank 16, the fixing tank 18, and the washing tank 20, respectively, it is possible to remove processing solution attached to the front and back surfaces of the photosensitive web 12.

The air knives 30A and 30B are preferably disposed as close to a portion where the photosensitive web 12 comes out from the surface of processing solution in each tank as possible. However, since the surface of the processing solution is disturbed and scattered by the air pressure, it is preferable to keep a distance for non-scattering and to provide all the tanks with covers 31 except for inlet portions and outlet portions for the photosensitive web 12.

Since the surface of the photosensitive web 12 having the developed silver image formed thereon is a wet soft film, the amount of air supplied to the air knives 30A and 30B is made small. When the developer is taken out from the developing tank 16 to therenext, liquid fatigue and solution physical development may easily occur in the fixing tank 18. To avoid this problem, it is preferable to dispose a stop bath tank after the developing tank 16.

Figure 2:
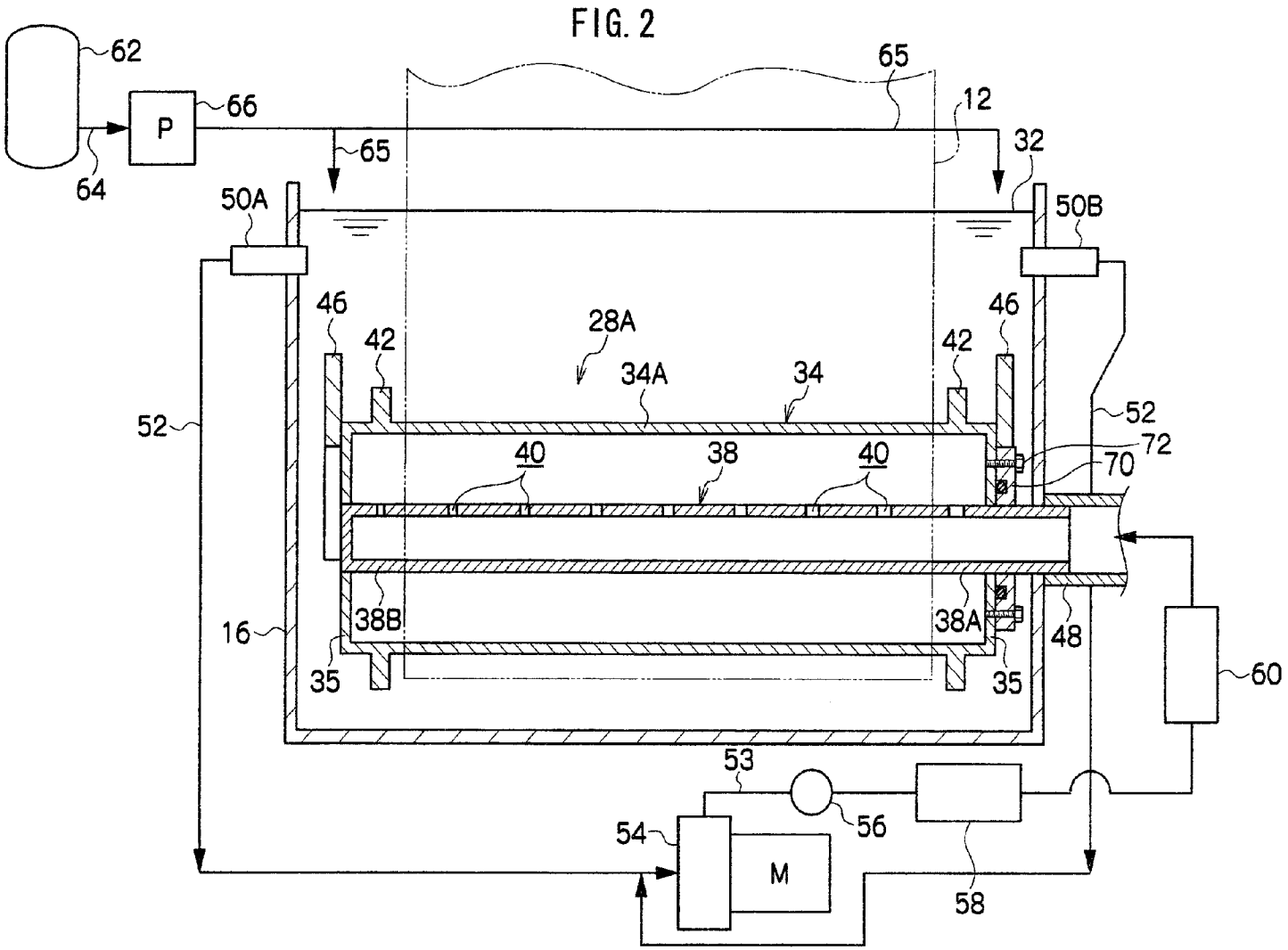
FIG. 2 is a view illustrating a configuration of an in-liquid turn bar used in the developing apparatus shown in FIG. 1 as cut along a longitudinal direction thereof.
Figure 3:
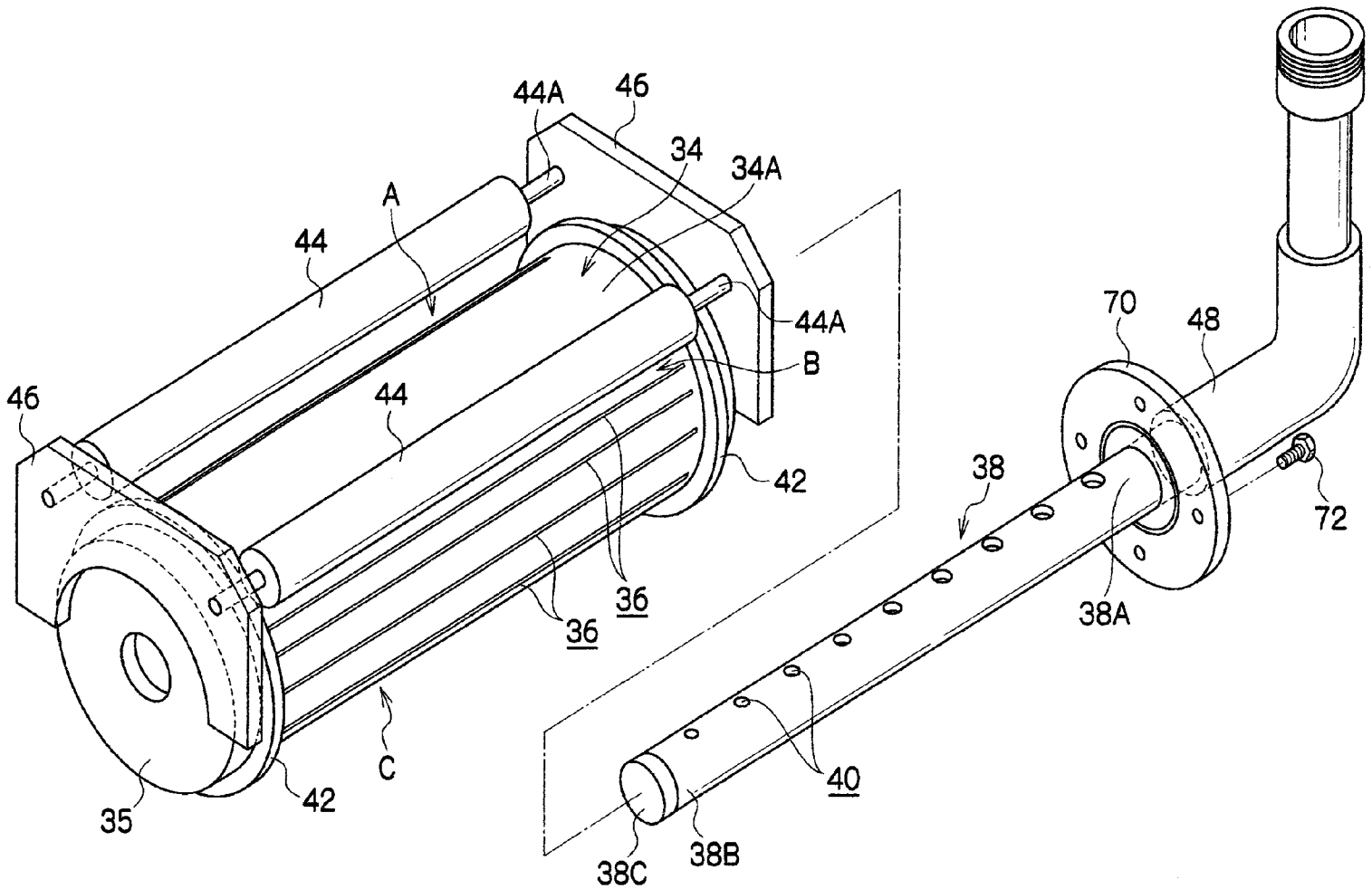
FIG. 3 is an exploded perspective view illustrating an in-liquid turn bar used in the developing apparatus shown in FIG. 1.
Figure 4B:
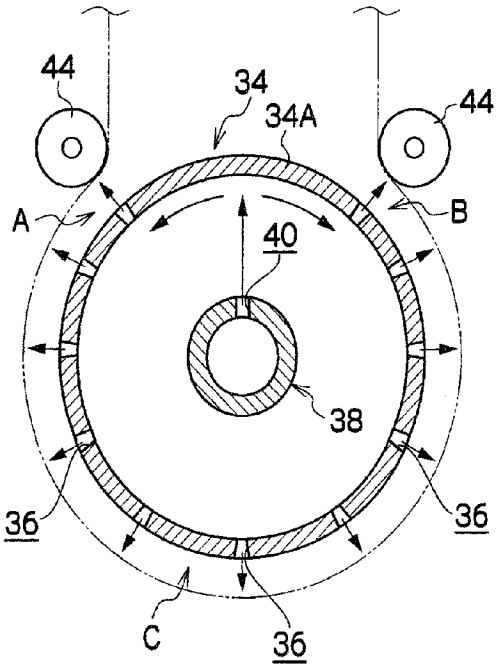
FIG. 4B is a view illustrating a configuration of the in-liquid turn bar as cut along a direction perpendicular to the longitudinal direction thereof.
Figure 4A:
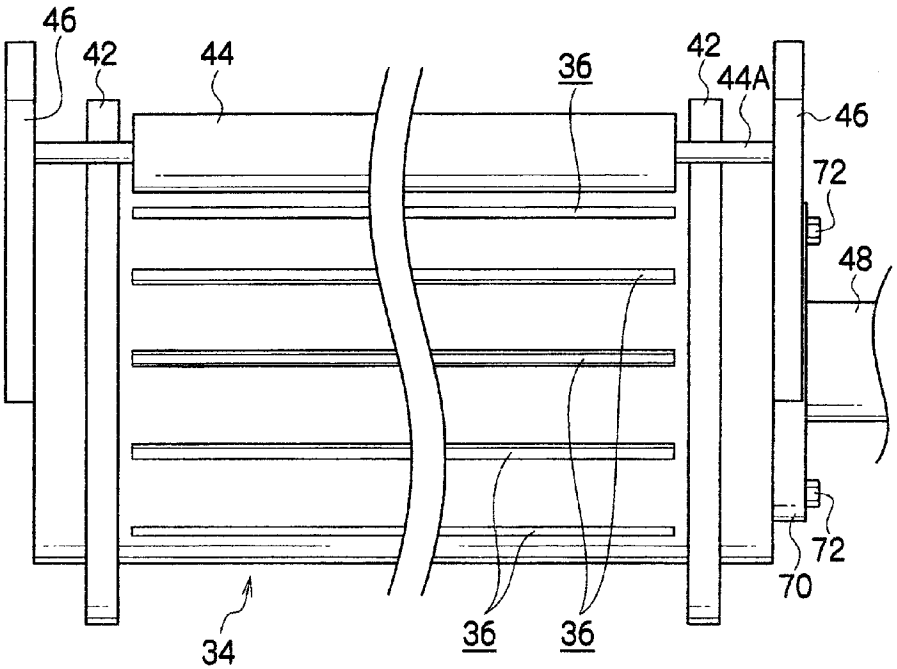
FIG. 4A is a side view illustrating an in-liquid turn bar used in the developing apparatus shown in FIG. 1.
Figure 4C:
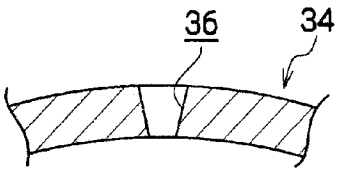
FIG. 4C is a partially enlarged view illustrating a discharge opening.

FIG. 2 shows a side sectional view of the in-liquid turn bar 28A disposed in the developing tank 16 as taken along a longitudinal direction, and FIG. 3 shows an exploded perspective view of the in-liquid turn bar 28A. FIG. 4A shows a side view of the in-liquid turn bar 28A, FIG. 4B shows a sectional view of the in-liquid turn bar 28A as taken along a direction perpendicular to the longitudinal direction, and FIG. 4C shows a partially enlarged view of a discharge opening. In addition, the in-liquid turn bar 28B disposed in the fixing tank 18 and the in-liquid turn bar 28C disposed in the washing tank 20 are different from the in-liquid turn bar 28A in that the discharge-liquid is fixer or pure water instead of developer, and the others are the same. Accordingly, the in-liquid turn bar 28A will be described herein by way of example.

As shown in FIG. 2, the in-liquid turn bar 28A is disposed in a direction substantially perpendicular to the conveying direction of the photosensitive web 12 in the developer 32 stored in the developing tank 16. As shown in FIGS. 2 to 4C, the in-liquid turn bar 28A includes a first cylindrical member 34 disposed outside and a second cylindrical member 38 disposed inside of the first cylindrical member 34. The first cylindrical member 34 has plural silt-shaped discharge openings 36 formed on the surface thereof along the longitudinal direction to discharge the developer. The second cylindrical member 38 has plural nozzles 40 formed on the surface thereof to eject the developer. Both ends of the first cylindrical member 34 are closed by ring-shaped members 35, and the second cylindrical member 38 is inserted into the central opening portions of the ring-shaped members 35.

In the first cylindrical member 34, intervals (intervals in circumferential direction) of the discharge openings 36 on the conveying-direction middle portion C of the photosensitive web 12 are larger than intervals of the discharge openings 36 in the vicinity of an inlet A on the conveying-direction upstream side of the photosensitive web 12 and in the vicinity of an outlet B on the conveying-direction downstream side. The intervals of the discharge openings 36 gets gradually smaller from the conveying-direction middle portion C of the photosensitive web 12 toward the vicinity of the inlet A on the conveying-direction upstream side and toward the vicinity of the outlet B on the conveying-direction downstream side. The first cylindrical member 34 is provided with a wall portion 34A having no discharge opening 36 at a portion (FIG. 3 and FIG. 4B) that is not faced to the photosensitive web 12 in the course of conveying. The developer is discharged from the plural slit-shaped discharge openings 36 of the first cylindrical member 34 and thus the photosensitive web 12 floats from the surface of the first cylindrical member 34, thereby turning the photosensitive web 12 without contacting the first cylindrical member 34.

In this case, since the intervals of the discharge openings 36 are formed gradually smaller from the conveying-direction middle portion C of the photosensitive web 12 toward the vicinity of the inlet A on the conveying-direction upstream side and toward the vicinity of the outlet B on the conveying-direction downstream side, the developer is discharged from the discharge openings 36 having the smaller intervals than those of the conveying-direction middle portion C in the vicinity of the inlet A and in the vicinity of the outlet B. The developer discharged from the discharge openings 36 of the first cylindrical member 34 is discharged in four directions of both transverse ends of the photosensitive web 12, the inlet A, and the outlet B. However, generally, the photosensitive web 12 and the first cylindrical member 34 tend to come into contact with each other in the vicinity of the inlet A and the outlet B of the photosensitive web 12. In the embodiment, in the vicinity of the inlet A and the outlet B of the photosensitive web 12, since the developer is discharged from the discharge openings 36 having the smaller intervals than those of the conveying-direction middle portion C, the developer is sufficiently discharged in the vicinity of the inlet A and the outlet B of the photosensitive web 12, thereby suppressing the contact between the band-shaped photosensitive material and the first cylindrical member.

Flange-shaped regulating plates 42, which protrude from the surfaces of the first cylindrical member 34 in a radial direction and regulate (control) the amount of developer flowed out (discharged) from both transverse ends of the photosensitive web 12, are disposed at both longitudinal ends of the first cylindrical member 34. The regulating plates 42 are disposed outside both transverse ends of the photosensitive web 12, that is, at a distance larger than the transverse length of the photosensitive web 12. In the embodiment, the regulating plates are disposed away from both edges of the photosensitive web 12 by about 10 mm. The amount of the developer discharged from both transverse ends of the photosensitive web 12 is controlled by the regulating plates 42, thereby adjusting a gap between the first cylindrical member 34 and the photosensitive web 12. The radial height of the regulating plate 42 is set larger than the gap between the first cylindrical member 34 and the photosensitive web 12 at the time when the photosensitive web 12 floats by discharge of the developer from the discharge openings 36.

The developer discharged from the discharge openings 36 of the first cylindrical member 34 is discharged in the four directions of both transverse ends of the photosensitive web 12, the inlet A, and the outlet B in the conveying direction of the photosensitive web 12. For this reason, when the developer is discharged from both transverse ends of the photosensitive web 12, a difference in staying time of the developer may occur between at the transverse middle portion and both transverse ends of the photosensitive web 12, and a difference in renewal of the developer on the surface of the silver salt containing layer may occur therebetween. As a result, a difference occurs in a developing progress of the silver salt and thus non-uniformity of the developed silver image may occur. In the embodiment, the regulating plates 42 are disposed to control the discharge of the developer from both transverse ends of the photosensitive web 12. Accordingly, pressure between the first cylindrical member 34 and the photosensitive web 12 is raised and thus it is possible to reduce the difference in staying time of the developer between at the transverse middle portion and at the transverse ends of the photosensitive web 12.

As shown in FIG. 4C, the discharge opening 36 of the first cylindrical member 34 has a tapered shape being narrow inside the first cylindrical member 34 and wide outside the first cylindrical member 34. With such a configuration, fluid pressure of the developer being discharged from the discharge openings 36 is suppressed from rising, and it is possible to suppress the film of the photosensitive web 12 being peeling off. In addition, the discharge openings 36 may be formed with the substantially same width at inside and outside the first cylindrical member 34 instead of the tapered shape of the embodiment.

When an opening ratio of the discharge openings 36 of the first cylindrical member 34 is small, the discharge amount of the developer is small and there is an advantage in allowing the photosensitive web 12 to float by keeping the pressure between the first cylindrical member 34 and the photosensitive web 12. Accordingly, a slit width of each of the discharge openings 36 is preferably in the range of 0.3 to 0.5 mm (a width of an inside narrow part). The opening ratio thereof is preferably 0.6 to 2%, and more preferably 0.8 to 1%. In this case, assuming that the slit width of the discharge opening 36 in the circumference direction is L (mm) and a diameter of the first cylindrical member 34 is D (mm), the opening ratio is obtained by the following equation:

$$\text{Opening ratio (\%)} = L \times \text{the number of slits}/\pi D$$

When the opening ratio of the discharge openings 36 is set in the range of 0.6 to 2%, it is possible to appropriately control the amount of the developer discharged from the plural discharge openings 36. In the case of "slit shape", it is generally known that distribution (deviation) in flow rate of discharged liquid may occur throughout the transverse direction. However, the distribution (deviation) in flow rate in a cylindrical member is removed by making the slit width of the discharge opening 36 small as much as 0.3 to 0.5 mm, and thus it is possible to allow the photosensitive web 12 to uniformly float in the transverse direction.

At the inlet A on the conveying-direction upstream side and the outlet B on the conveying-direction downstream side of the photosensitive web 12, guide rollers 44 are disposed at a predetermined distance from the surface of the first cylindrical member 34. Support members 46 are disposed at both longitudinal ends of the first cylindrical member 34, and shaft portions 44A of the guide rollers 44 are rotatably supported to the support members 46. The photosensitive web 12 is guided by the guide rollers 44 in the conveying direction, and thus the photosensitive web 12 is suppressed from coming into contact with the first cylindrical member 34 in the vicinity of the inlet A and the outlet B.

In the embodiment, the first cylindrical member 34 is a hollow cylindrical member, but may be an oval or half-cylindrical member.

Figure 5:
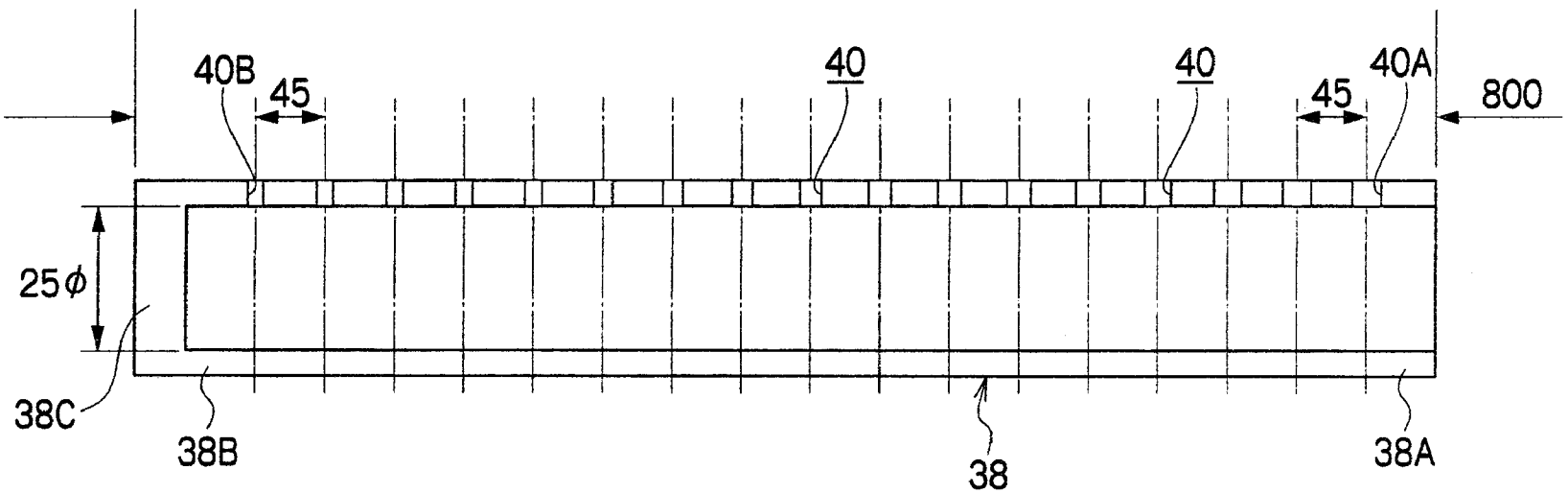
FIG. 5 is a view illustrating a configuration of a second cylindrical member used in an in-liquid turn bar as cut along a longitudinal direction thereof.

The second cylindrical member 38 is inserted into the first cylindrical member 34 over the whole width. A pipe-shaped introduction portion 48 for introducing the developer is connected to one longitudinal end 38A of the second cylindrical member 38, and a longitudinal other end 38B is closed by a cover portion 38C. At one end 38A of the second cylindrical member 38, at a portion at the center side than the pipe-shaped introduction portion 48, a ring-shaped mounting plate 70 is disposed in the circumference of the second cylindrical member 38, and the mounting plate 70 is mounted on the first cylindrical member 34 by screws 72. On the second cylindrical member 38, plural circular nozzles 40 are formed along the longitudinal direction. The plural nozzles 40 have small diameters on the other longitudinal end side 38B and the diameters are formed gradually larger as they go from the other end 38B to the one longitudinal end 38A. The plural nozzles 40 are arranged so that centers thereof are at the same intervals. The sum of the diameters of the nozzles 40 is equal to the inner diameter of the second cylindrical member 38 and the diameters are determined by pressure loss calculation and experiment. In the embodiment, as shown in FIG. 5, the interval between the centers of the nozzles 40 is about 45 mm, the inner diameter of the second cylindrical member 38 is about 25 mm, and the transverse length of the second cylindrical member 38 is about 800 mm. The diameter of the nozzle 40A closest to the introduction side at the one longitudinal end 38A side of the second cylindrical member 38 is about 6.8 mm, the diameter of the nozzle 40B closet to the terminal side at the other longitudinal end 38B side of the second cylindrical member 38 is about 5.4 mm.

In the second cylindrical member 38, the diameters of the plural nozzles 40 are formed gradually larger as they go from the other longitudinal end 38B to the one end 38A, and the centers of the nozzles 40 are arranged at the same intervals. Accordingly, the developer discharged from the plural discharge openings 36 of the first cylindrical member 34 is substantially uniform in the transverse direction. When the plural nozzles of the second cylindrical member 38 have the same diameter from the one longitudinal end 38A to the other longitudinal end 38B or the second cylindrical member 38 is disposed only on the introduction side in the first cylindrical member 34, static pressure is large at the other end 38B of the first cylindrical member 34 (terminal side) and the amount of the developer discharged from the discharge openings 36 at this side increases. Therefore, the amount of the developer discharged from the discharge openings 36 at the one end 38A side (introduction side) decreases.

As shown in FIG. 4B, the plural nozzles 40 are formed at a position (the upper portion in FIGS. 3 and 4B) faced to the wall portion 34A of the first cylindrical member 34 where no discharge opening 36 is formed. When the plural nozzles 40 are formed at the position faced to the wall portion 34A of the first cylindrical member 34, the developer discharged from the plural nozzles 40 abuts the wall portion 34A of the first cylindrical member 34 so as to suppress dynamic pressure, and the developer flowing to both ends of the wall portion 34A is discharged from the discharge openings 36 of the first cylindrical member 34, thereby suppressing short pass that the developer ejected from the plural nozzles 40 is directly discharged from the discharge openings 36 of the first cylindrical member 34.

As shown in FIG. 2, developer inhalant ports 50A and 50B are disposed above the developing tank 16, and pipes 52 respectively connected to the developer inhalant ports 50A and 50B becomes one pipe 53. The pipe 53 is provided with a pump 54, an automatic constant flow valve (flow control valve) 56, a flowmeter 58, and a plate-type heat exchanger 60. A downstream end of the pipe 53 is connected to the pipe-shaped introduction portion 48. The automatic constant flow valve 56 is installed to remove variation in flow rate caused by variation in pressure, the flowmeter 58 is installed to manage the flow rate, and the plate-type heat exchanger 60 is installed to keep temperature in the tank substantially constant.

A supplement tank 62 for storing supplement developer is provided separately from the developing tank 16, the supplement tank 62 is connected to a pipe 64, and the pipe 64 is provided with a pump 66. A downstream side of the pipe 64 is divided into two pipes 65, and the pipes 65 are introduced to the vicinity of the developer inhalant ports 50A and 50B above the developing tank 16, respectively. In developing the photosensitive web 12, it is important to replenish the developer in accordance with the amount of developing of the photosensitive web 12. In the embodiment, the developer is supplied to the in-liquid turn bar 28A by circulating the developer 32 in the developing tank 16. It is possible to keep the concentration of the developer 32 in the developing tank 16 substantially uniform by replenishing developer onto the circulating path. The replenished developer is dripped in the vicinity of the developer inhalant ports 50A and 50B on the circulating path, it is mixed in the pipes 52 and 53 of turbulent flow, and is substantially uniformly supplied to the second cylindrical member 38 inside the in-liquid turn bar 28A in the transverse direction. In addition, after the developer is discharged from the plural discharge openings 36 of the first cylindrical member 34, the developer is discharged from the inlet A and the outlet B of the photosensitive web 12 and from both transverse ends of the photosensitive web 12, and the developer becomes uniform by flow and diffusion in the developing tank 16.

In such an in-liquid turn bar 28A, it is set that the developer is discharged from the plural slit-shaped discharge openings 36 of the first cylindrical member 34 such that the discharge amount (discharge rate) of the developer per 1 m of the first cylindrical member 34 is 50 to 200 l/min (litter/minute). The discharge amount of the developer per 1 m is preferably 70 to 150 l/min (litter/minute), and more preferably 80 to 100 l/min (litter/minute).

Tension at the time of conveying the photosensitive web 12 is preferably 3 N/m or more and 150 N/m or less. When the tension is less than 3 N/m, the support roller 26 is not rotated to cause scratch on the film. When the tension is more than 150 N/m, the photosensitive web 12 is wrinkled and the film comes into contact with the surface of the in-liquid turn bar, thereby causing scratch on the developed silver image.

Temperature of the developer in the developing apparatus 10 is based on a film strength of the silver salt containing layer of the photosensitive web 12 and a developing rate, the temperature is preferably in the range of 16° C. to 40° C., and more preferably in the range of 20° C. to 36° C.

An operation of the in-liquid turn bar 28A, to which the developing method according to the embodiment is applied, will be described.

The developer 32 is supplied to the in-liquid turn bar 28A such that the developer 32 is sent from developer inhalant ports 50A and 50B disposed above the developing tank 16 through the pipes 52 and 53 to the pump 54, and, through the automatic constant flow valve 56, the flowmeter 58, and the plate-type heat exchanger 60, is introduced from the pipe-shaped introduction portion 48 to the second cylindrical member 38. In the second cylindrical member 38, the diameters of the plural nozzles 40 are formed gradually larger as they go from the other longitudinal end 38B to the one end 38A, the developer is substantially uniformly in the transverse direction ejected from the plural nozzles 40 into the first cylindrical member 34. At this time, as shown in FIG. 4B, the developer is ejected from the plural nozzles 40 of the second cylindrical member 38 in direction (represented by an arrow) toward the wall portion 34A in the first cylindrical member 34, the developer flowing to the both sides of the wall portion 34A of the first cylindrical member 34 is discharged from the plural slit-shaped discharge openings 36 of the first cylindrical member 34 to the gap between the first cylindrical member 34 and the photosensitive web 12 due to pressure sent by the pump 54. The developer discharged from the plural discharge openings 36 is discharged from the inlet A and the outlet B in the vicinity of the guide rollers 44 of the photosensitive web 12 and from both transverse ends of the photosensitive web 12 at both transverse ends of the first cylindrical member 34. The photosensitive web 12 is allowed to float from the first cylindrical member 34 by the developer discharged from the plural discharge openings 36, and the photosensitive web 12 is conveyed and turned without contacting with the first cylindrical member 34.

The developer (replenished liquid) replenished from the supplement tank 62 is sent through the pipe 64 to the pump 66, passes through the pipe 65, and is dripped in the vicinity of the developer inhalant ports 50A and 50B of the developing tank 16. The dripped developer (replenished liquid) is completely mixed by turbulent flow in the pipes 52 and 53 on the circulating path, and is substantially uniformly in the transverse direction ejected from the plural nozzles 40 of the second cylindrical member 38 into the first cylindrical member 34.

In such an in-liquid turn bar 28A, it is set that the developer is discharged from the plural slit-shaped discharge openings 36 of the first cylindrical member 34 so that the discharge amount of the developer per 1 m is 50 to 200 l/min. Accordingly, the photosensitive web 12 is allowed to substantially uniformly in the transverse direction float from the surface of the in-liquid turn bar 28A (first cylindrical member 34), and thus the photosensitive web 12 and the surface of the in-liquid turn bar 28A are kept at a predetermined gap. For this reason, silver stain, scratch, or the like of the photosensitive web 12 caused by contact between the surface of the in-liquid turn bar 28A and the photosensitive web 12 is suppressed, and film peeling (the silver salt coating film, the developed silver image is peeled off) or the like caused by high discharge flow of the developer is suppressed. Therefore, it is possible to obtain a substantially uniform developed silver image (the metal silver portion) without non-uniformity in the transverse direction of the photosensitive web 12.

When the discharge amount of the developer per 1 m in the in-liquid turn bar 28A is lower than 50 l/min, the photosensitive web 12 does not sufficiently float from the surface of the in-liquid turn bar 28A, and silver stain, scratch, or the like may occur in the photosensitive web 12 by contact between the surface of the in-liquid turn bar 28A and the photosensitive web 12. When the discharge amount of the developer per 1 m in the in-liquid turn bar 28A is higher than 200 l/min, the discharge flow of the developer becomes higher and thus film peeling and the line may occur. Note that frequency of occurrence of film peeling becomes different depending on type of the photosensitive web 12. For example, film peeling may easily occur in a case of the photosensitive web which is not subject to hardening process (non-harden photosensitive web). In the present invention, discharge amount of the developer is adjusted by using the in-liquid turn bar having the structure mentioned above. Accordingly, developing can be performed efficiently to the photosensitive web which is not subject to hardening process. In the present invention, "subject to hardening process" is that a hardening agent is added in the silver salt photosensitive layer and thus gelatin film characteristic is strengthened, and "not subject to hardening process" is that a hardening agent is not added.

The amount of the developer discharged from both transverse ends of the photosensitive web 12 at both ends of the in-liquid turn bar 28A is controlled by the regulating plate 42, thereby adjusting the gap between the photosensitive web 12 and the in-liquid turn bar 28A. Accordingly, the gap between the photosensitive web 12 and the in-liquid turn bar 28A becomes substantially uniform, silver stain, scratch, or the like of the photosensitive web 12 caused by contact between the surface of the in-liquid turn bar 28A and the photosensitive web 12 is suppressed from occurring, and the gap between the photosensitive web 12 and the in-liquid turn bar 28A is kept constant even in a case of small discharge flow of the developer.

An opening ratio of the discharge openings 36 of the first cylindrical member 34 is set in the range of 0.6 to 2%, so that the amount of the developer discharged from the plural discharge openings 36 is appropriately adjusted and thus the gap between the photosensitive web 12 and the in-liquid turn bar 28A becomes substantially uniform. For this reason, silver stain, scratch, film peeling, or the like of the photosensitive web 12 is suppressed from occurring. When the opening ratio of the discharge openings 36 is smaller than 0.6%, the amount of the developer discharged from the discharge openings 36 is not sufficient and thus silver stain, scratch, or the like of the photosensitive web 12 may occur by contact between the surface of the in-liquid turn bar 28A and the photosensitive web 12. When the opening ratio of the discharge openings 36 is larger than 2%, it is necessary to raise the discharge flow of the developer and thus film peeling or the like may occur.

The photosensitive web 12 developed by the developing apparatus 10 of the invention can be properly used for a light transmittable electromagnetic wave shield film. So, it is possible that a substantially uniform without non-uniformity light transmittable electromagnetic wave shield film (the conductive layer-attached film) is obtained by plating to the developed silver image (the metal silver portion) of the photosensitive web 12 to form the conductive layer.

Next, the photosensitive web 12 will be described. The photosensitive web 12 is, for example, a longitudinal wide width flexible base material made of a photosensitive material, in which a silver salt containing layer that contains silver salt (e.g., silver halide) is provided onto a light transmittable base (a base film). A protective layer may be formed on the silver salt containing layer. The protective layer means a layer made of binder such as gelatin and macromolecule polymer, and is formed on the silver salt containing layer to exhibit effects of prevention of abrasion or improvement of dynamic characteristics. A thickness of the protective layer is preferably 0.02 to 20 μm, more preferably 0.1 to 10 μm, and further more preferably 0.3 to 3 μm.

As composition or the like of the silver salt containing layer or the protective layer, a silver halide emulsion layer (silver salt containing layer) or a protective layer, which is applied to a silver salt photographic film, photographic paper, photographic film for plate-making, an emulsion mask for a photomask, or the like, is applicable.

Particularly, as the photosensitive web 12 (photosensitive material), a silver salt photographic film (silver salt photosensitive material) is preferable, and a black-and-white silver salt photographic film (black-and-white photosensitive material) is most preferable. As the silver salt applied to the silver salt containing layer, particularly, silver halide is most preferable.

As the light transmittable base, a single-layered plastic film or a multi-layered film formed of two or more single-layered films is applicable. As raw materials of a plastic film, for example, there may be used polyester such as polyethylene terephthalate (PET) and polyethylene naphthalate; polyolefin such as polyethylene (PE), polypropylene (PP), polystyrene, and EVA; vinyl resin such as polyvinyl chloride and polyvinylidene chloride; and the others such as polyether ether ketone (PEEK), polysulfone (PSF), polyether sulfone (PES), polycarbonate (PC), polyamide, polyimide, acryl resin, triacetyl cellulous (TAC), and the like.

Among them, from viewpoint of transparency, heat resistance, easiness in dealing, and cost, a plastic film as the base is preferably a polyethylene terephthalate film generally applied to a silver salt photographic film (silver salt photosensitive material), a cellulous triacetate film, and others such as a polyimide film. Particularly, a polyethylene terephthalate film is most preferable.

In an electromagnetic wave shield material for display, transparency is necessary, and thus the base preferably has high transparency. In this case, all visible light transmittance of the light transmittable base is preferably 70 to 100%, more preferably 85 to 100%, and further more preferably 90 to 100%.

For example, a width of the photosensitive web 12 is preferably 50 cm or more, and a thickness thereof is preferably 50 to 200 μm.

EXAMPLES

Hereinafter, the invention will be described in more detail with reference to the following examples. The invention is not limited to the examples. The obtained developed silver image film is assessed by the following method.

[Assessment Method]

<Developed Silver Non-Uniformity>

By means of a silver content analyzer, the dispersion of the developed silver in the transverse direction is compared with the dispersion of amount of silver of the silver salt containing layer before the developing process.

<Film Surface Texture>

It is judged whether film peeling, scratch, and stain exists or not by a naked-eye examination in transmitted light and reflective light, 10-magnification loupe, and an optical telescope of 50 magnifications.

Production Example 1

Production of Silver Salt Containing Photosensitive Material Coating Sample

An emulsion layer coating liquid adjusted using iodide salt silver bromide emulsion with an average grain size of 0.22 μm and a coefficient of variation of 9% including silver chloride of 70 mol % and silver iodide of 0.08 mol % is applied onto polyethylene terephthalate (PET) with a width of 65 cm so that Ag is 7.8 g/m$^2$ and gelatin is 0.94 g/m$^2$, and then is dried, thereby obtaining a coating sample.

(Exposure)

Then, the dried coating film is exposed through a lattice-shaped photomask having a lattice-shaped space of line/space=5 μm/195 μm (pitch 200 μm), which is capable of applying developed silver of line/space=5 μm/195 μm, by using parallel light from a high-pressure mercury lamp serving as a light source.

Example 1

The exposed film (photosensitive web 12) obtained in Production Example 1 is developed by the developing apparatus 10 shown in FIG. 1. In the developing apparatus 10, the first tank is the developing tank 16, and developer of about 100 litter is stored in the developing tank 16 with width 0.9 m×length 0.25 m×height 0.5 m and is kept at a temperature of 20° C. The second tank is the fixing tank 18, and fixer of about 200 litter is stored in the fixing tank 18 with width 0.9 m×length 0.25 m×height 1 m and is kept at a temperature of 20° C. The third tank is the washing tank 20, and pure water of about 200 litter is stored in the washing tank 20 with width 0.9 m×length 0.25 m×height 1 m and is kept at a temperature of 20° C. The pure water of 2 litter per minute is supplied and overflows from the washing tank 20.

The developing tank 16, the fixing tank 18, and the washing tank 20 are provided with the in-liquid turn bars 28A, 28B, and 28C (hereinafter, A, B, and C are omitted when it is not necessary to distinguish 28A, 28B, and 28C), respectively. In the in-liquid turn bar 28, the processing solution is substantially uniformly discharged from the plural discharge openings 36 in the transverse direction, and processing solution in the tank is circulated so as to be substantially uniform. In the in-liquid turn bar 28A disposed in the developing tank 16, the developer is discharged from the plural slit-shaped discharge openings 36 of the first cylindrical member 34, at a discharge amount (rate) per 1 m of 50 to 200 l/min. The amount of the developer flowed out from both ends of the film (photosensitive web 12) is controlled by the regulating plates 42 at both ends of the in-liquid turn bar 28A, and an opening ratio of the discharge openings 36 is set in the range of 0.6 to 2%.

Figure 8:
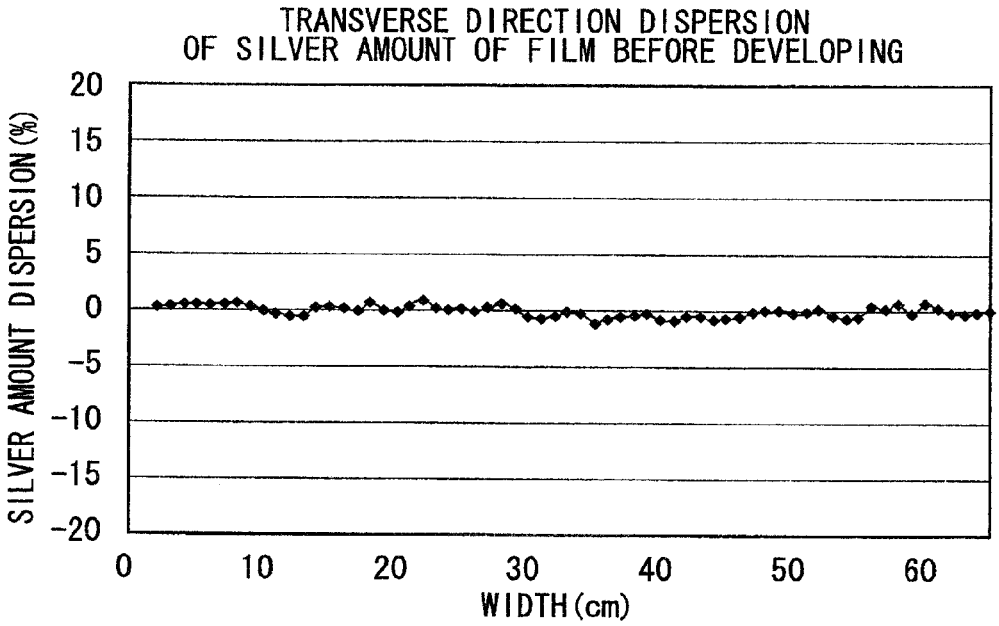
FIG. 8 is a graph illustrating Ag amount dispersion in the transverse direction before development of a film.

A film (photosensitive web 12) is conveyed at a speed of 1.0 m/min in the developing apparatus 10 shown in FIG. 1. A staying time in the developing tank 16 is about 60 seconds in liquid, and staying times in the fixing tank 18 and the washing tank 20 are 2 minutes in liquid, respectively. The processing solution is scraped and separated from the film at the outlet of each tank by the air knives 30A and 30B, and the film is dried by warm air of 50° C. blowing from the warm air generating devices 22A and 22B, thereby obtaining a desired developed silver image film. An assessment result of a film A-1 subjected to such a development is shown in Table 1 and FIG. 6. In addition, an Ag amount dispersion of a film (film A) before development is shown in FIG. 8.

Comparative Example 1

Figure 7:
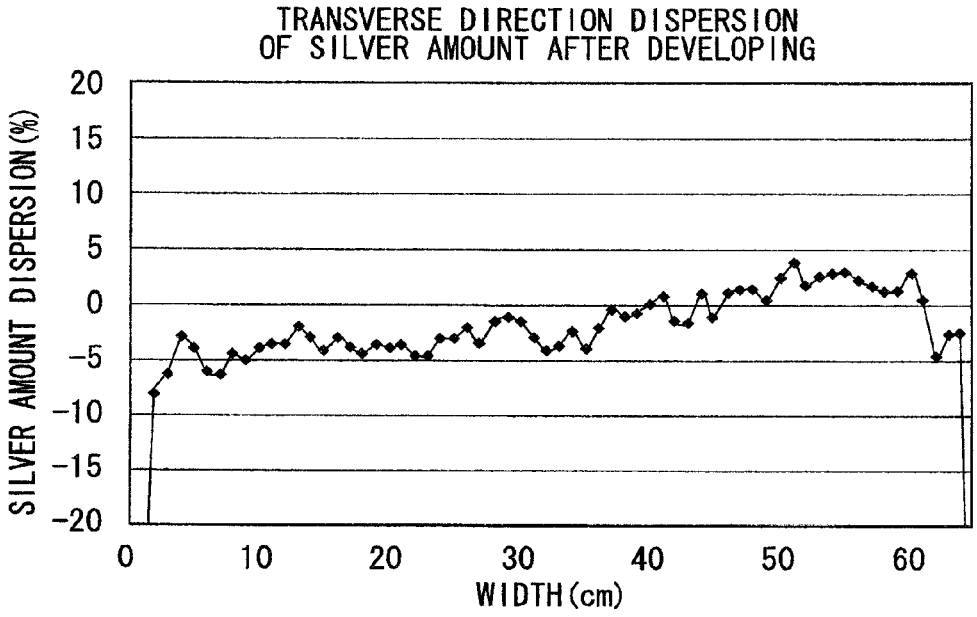
FIG. 7 is a graph illustrating Ag amount dispersion in the transverse direction after development of a film of Comparative Example 1.

A film (photosensitive web 12) is developed by the developing apparatus 10 shown in FIG. 1, in which the second cylindrical member 38 is not provided in the in-liquid turn bar 28 shown in FIG. 2, by introducing processing solution from one end (one of the ends) of the in-liquid turn bar 28, under the condition of Example 1. A result of the obtained film A-2 is shown in Table 1 and FIG. 7.

Comparative Example 2

Figure 9:
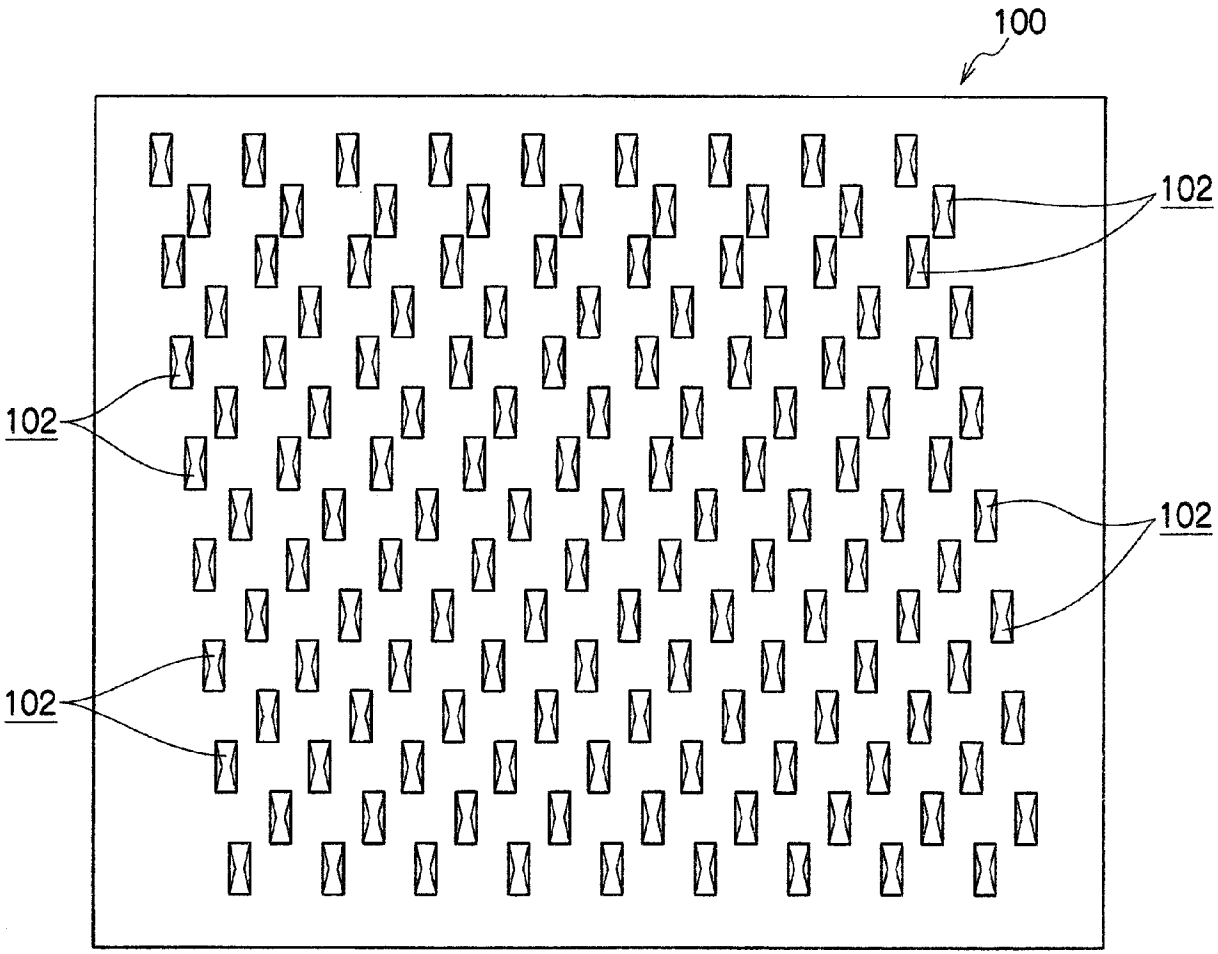
FIG. 9 is a side view illustrating a first cylindrical member used in an in-liquid turn bar of Comparative Example 2.

A first cylindrical member 100 shown in FIG. 9 is provided instead of the first cylindrical member 34 disposed in the in-liquid turn bar 28 shown in FIG. 3, using the developing apparatus 10 shown in FIG. 1. In the first cylindrical member 100, plural square discharge openings 102 are arranged on a surface thereof in zigzag. The other configurations of the in-liquid turn bar 28 are the same, and a film (photosensitive web 12) is developed under the condition of Example 1. A result of the obtained film A-3 is shown in Table 1.

TABLE 1

| | Film No. | Second cylindrical member | Regulating plate | Air knife | Surface texture |
|---|---|---|---|---|---|
| | A | — | — | — | Good (None of scratch, stain, non-uniformity) |
| Example 1 | A-1 | Use | Use | Use | Good (None of scratch, stain, non-uniformity) |
| Comparative Example 1 | A-2 | None | Use | Use | NG (Scratch by friction existed) |
| Comparative Example 2 | A-3 | Use | Use | Use | NG (Shading stripes of same interval throughout the whole width existed) |

Figure 6:
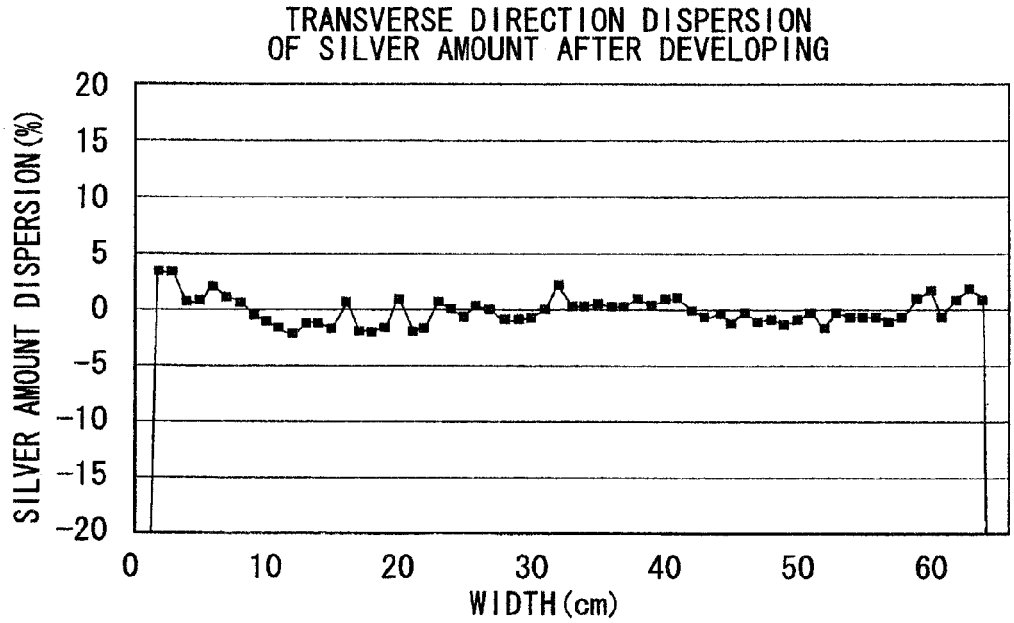
FIG. 6 is a graph illustrating Ag amount dispersion in the transverse direction after development of a film of Example 1.

As shown in Table 1 and FIG. 6, the developed sliver image film obtained by the developing apparatus 10 of the invention does not have scratch, stain, and non-uniformity on the surface, and a transverse developed silver amount dispersion is substantially uniform. As shown in Table 1 and FIG. 7, although the processing solution is supplied from one end (one of the ends) to the in-liquid turn bar 28 in Comparative Example 1, in amount of the processing solution discharged from the in-liquid turn bar 28, the amount at the opposite side is larger than that at the processing solution supplying side, and the floating of the film is different at the transverse left side and at the transverse right side. Accordingly, a scraped mark is observed on the surface of the film, balance of silver distribution between the left side and the right side deteriorates. As shown in FIG. 1, although the first cylindrical member 100 is used in Comparative Example 2, same-interval shading stripes are observed throughout the whole width of the film.

Example 2 to Example 6

Next, development is performed by the developing apparatus 10 shown in FIG. 1, by changing a discharge flow amount (rate) of the developer from the first cylindrical member 34, using a non-hardening film B and a film C in which hardening agent is added by 1% in gelatin to harden a gelatin film.

As shown in Table 2, the assessments are performed with respect to kinds of the used films and discharge flow rates of the developer under the different conditions such as Example 2 to Example 6, Comparative Example 3, and Comparative Example 4.

The non-hardening film B is the film represented in Production Example 1, which is not gelatin-hardened (Film Nos. B-1 to B-6 in Table 2). The film C is the film represented in Production Example 1, in which, as gelatin-hardened, hardening agent is added by 1% in gelatin, coated onto PET, and dried (Film No. C-1 in Table 2).

TABLE 2

| | Film No. | Flow rate of First cylindrical member | Film texture |
|---|---|---|---|
| Comparative Example 3 | B-1 | 40 L/min · m | NG (Film peeling off by friction occurred) |
| Example 2 | B-2 | 50 L/min · m | Good (None of scratch, stain, non-uniformity) |
| Example 3 | B-3 | 100 L/min · m | Good (None of scratch, stain, non-uniformity) |
| Example 4 | B-4 | 150 L/min · m | Good (None of scratch, stain, non-uniformity) |
| Example 5 | B-5 | 200 L/min · m | Good (None of scratch, stain, non-uniformity) |
| Comparative Example 4 | B-6 | 250 L/min · m | NG (Film peeling off occurred) |
| Example 6 | C-1 | 200 L/min · m | Good (None of scratch, stain, non-uniformity) |

An assessment result of film texture is shown in Table 2. As shown in Comparative example 3, at a discharge flow rate of 40 L/min·m, the gap between the first cylindrical member 34 and the film B-1 becomes small, the film B-1 sometime comes into contact with the first cylindrical member 34, it is observed that the developer is blurred because the coating film is peeled off, there is scratch on the dried film B-1, and there is a part having no image.

As shown in Example 2 to Example 5, in the range of discharge flow rates of 50 L/min·m to 200 L/min·m, the gap between the first cylindrical member 34 and the films B-2 to B-5 is substantially constantly kept in the transverse direction, and the films are stably conveyed. There is no stripe and scratch on the dried films B-2 to B-5, which is good.

As shown in Comparative Example 4, at a discharge flow rate of 250 L/min·m, the gap between the first cylindrical member 34 and the film B-6 is secured and the film is stably conveyed. However, the coating film on the film B-6 is peeled off by jet flow, and it is observed that the developer is blurred. There is a film peeling-off mark on the dried film B-6, and there is non-uniformity on the image.

As shown in Example 6, when the development is performed using the film C-1 in which the coating film is strengthened with hardening agent, at a discharge flow rate of 200 L/min·m, there is no blur of the developer and the after-dried film C-1 is good.

In the embodiment, the apparatus and the method for producing a light transmittable electromagnetic shield material are described, but the invention is not limited thereto. For example, the invention may be applied to an apparatus and a method for producing a light transmittable conductive material having a fine line-shaped pattern made of fine conductive metal, such as the other industrial products.

What is claimed is:

1. A method of developing a photosensitive material, the method comprising:

conveying a band-shaped photosensitive material having a silver salt containing layer on a base film with gelatin being provided on the silver salt containing layer as a binder into developer to develop the photosensitive material; and turning the band-shaped photosensitive material by a photosensitive material turning member disposed in a direction crossing a conveying direction of the band-shaped photosensitive material in the developer, wherein the developer is discharged from a plurality of slit-shaped discharge openings formed on a surface of the photosensitive material turning member along a longitudinal direction thereof, so that a discharge amount of the developer is from 50 l/min to 200 l/min per 1 m of the photosensitive material turning member, such that the band-shaped photosensitive material floats with respect to the photosensitive material turning member and is turned without contacting the photosensitive material turning member.

2. The method of developing a photosensitive material of claim 1, wherein an opening ratio of the discharge openings is from 0.6 to 2% to control an amount of the developer discharged from the discharge openings.

3. The method of developing a photosensitive material of claim 1, wherein the photosensitive material turning member includes:

a first cylindrical member disposed in a direction crossing the conveying direction of the band-shaped photosensitive material that has, on a surface thereof in a longitudinal direction, the plurality of the slit-shaped discharge openings that discharge the developer; and a second cylindrical member disposed inside the first cylindrical member that has nozzles that eject the developer.

4. The method of developing a photosensitive material of claim 3, further comprising regulating plates disposed at both longitudinal ends of the first cylindrical member that protrude from a surface of the first cylindrical member, and that regulate the amount of the developer that flows away from both transverse ends of the band-shaped photosensitive material.

5. The method of developing a photosensitive material of claim 4, wherein heights of the regulating plates from the surface of the first cylindrical member are larger than a gap between the surface of the first cylindrical member and the floated band-shaped photosensitive material.

6. The method of developing a photosensitive material of claim 3, wherein the second cylindrical member is provided with an introduction portion that introduces the developer at one longitudinal end of the second cylindrical member, and the nozzles are a plurality of nozzle holes formed in the longitudinal direction, and the nozzle holes formed at the other longitudinal end are smaller than the nozzle holes formed at the one longitudinal end.

7. The method of developing a photosensitive material of claim 6, wherein the nozzle holes become gradually larger from the other longitudinal end to the one longitudinal end of the second cylindrical member.

8. The method of developing a photosensitive material of claim 3, wherein the first cylindrical member has no discharge opening at a portion that faces the nozzles of the second cylindrical member.

9. The method of developing a photosensitive material of claim 1, wherein the gelatin comprises a protective layer having a thickness of from 0.02 to 20 μm.

10. The method of developing a photosensitive material of claim 9, wherein the protective layer having a thickness of from 0.3 to 3 μm.

11. The method of developing a photosensitive material of claim 9, wherein the protective layer further comprises a macromolecule polymer.

12. A method of producing a conductive layer-attached film, the method comprising:

forming a metal silver portion by developing a band-shaped photosensitive material by using a method of developing a photosensitive material, the method comprising:

conveying the band-shaped photosensitive material having a silver salt containing layer on a base film with gelatin being provided on the silver salt containing layer as a binder into developer to develop the photosensitive material;

turning the band-shaped photosensitive material by a photosensitive material turning member disposed in a direction crossing a conveying direction of the band-shaped photosensitive material in the developer, wherein the developer is discharged from a plurality of slit-shaped discharge openings formed on a surface of the photosensitive material turning member along a longitudinal direction thereof, so that a discharge amount of the developer is from 50 l/min to 200 l/min per 1 m of the photosensitive material turning member, such that the band-shaped photosensitive material floats with respect to the photosensitive material turning member and is turned without contacting the photosensitive material turning member; and plating for forming a conductive layer on the metal silver portion.

13. The method of producing a conductive layer-attached film of claim 12, wherein the gelatin comprises a protective layer having a thickness of from 0.02 to 20 μm.

14. The method of producing a conductive layer-attached film of claim 13, wherein the protective layer having a thickness of from 0.3 to 3 μm.

15. The method of producing a conductive layer-attached film of claim 13, wherein the protective layer further comprises a macromolecule polymer.

16. A method of developing a photosensitive material, the method comprising:

conveying a band-shaped photosensitive material having a silver salt containing layer on a base film into developer to develop the photosensitive material; and turning the band-shaped photosensitive material by a photosensitive material turning member disposed in a direction crossing a conveying direction of the band-shaped photosensitive material in the developer, wherein the developer is discharged from a plurality of slit-shaped discharge openings formed on a surface of the photosensitive material turning member along a longitudinal direction thereof, so that a discharge amount of the developer is from 50 l/min to 200 l/min per 1 m of the photosensitive material turning member, such that the band-shaped photosensitive material floats with respect to the photosensitive material turning member and is turned without contacting the photosensitive material turning member, wherein the photosensitive material turning member includes:

a first cylindrical member disposed in a direction crossing the conveying direction of the band-shaped photosensitive material that has, on a surface thereof in a longitudinal direction, the plurality of the slit-shaped discharge openings that discharge the developer; and a second cylindrical member disposed inside the first cylindrical member that has nozzles that eject the developer, and intervals between the discharge openings on a conveying direction upstream side and a conveying-direction downstream side are smaller than intervals between the discharge openings at a conveying-direction middle portion.

17. A method of developing a photosensitive material, the method comprising:

conveying a band-shaped photosensitive material having a silver salt containing layer on a base film into developer to develop the photosensitive material; and turning the band-shaped photosensitive material by a photosensitive material turning member disposed in a direction crossing a conveying direction of the band-shaped photosensitive material in the developer, wherein the developer is discharged from a plurality of slit-shaped discharge openings formed on a surface of the photosensitive material turning member along a longitudinal direction thereof, so that a discharge amount of the developer is from 50 l/min to 200 l/min per 1 m of the photosensitive material turning member, such that the band-shaped photosensitive material floats with respect to the photosensitive material turning member and is turned without contacting the photosensitive material turning member, wherein the photosensitive material turning member includes:

a first cylindrical member disposed in a direction crossing the conveying direction of the band-shaped photosensitive material that has, on a surface thereof in a longitudinal direction, the plurality of the slit-shaped discharge openings that discharge the developer; and a second cylindrical member disposed inside the first cylindrical member that has nozzles that eject the developer, and the discharge openings are formed in a tapered shape, which are wider on a front surface side of the first cylindrical member and narrower on a rear surface side of the first cylindrical member.

* * * * *